United States Patent [19]

Iwaki et al.

[11] 4,400,929

[45] Aug. 30, 1983

[54] APPARATUS FOR FORMING BOX-SHAPED COVERING BODY

[75] Inventors: Takashi Iwaki; Takeji Tanaka, both of Kisarazu, Japan

[73] Assignee: Yuwa Sangyo Kabushiki Kaisha, Tokyo, Japan

[21] Appl. No.: 234,772

[22] Filed: Feb. 17, 1981

[30] Foreign Application Priority Data

Mar. 3, 1980 [JP] Japan ..... 55-25191

[51] Int. Cl.[3] ..... B65B 11/00

[52] U.S. Cl. ..... 53/580; 53/218; 72/306; 72/319

[58] Field of Search ..... 53/397, 580, 218; 72/306, 319

[56] References Cited

U.S. PATENT DOCUMENTS

| | | | |
|---|---|---|---|
| 656,826 | 8/1900 | Peters | 53/218 X |
| 2,027,010 | 1/1936 | Zeigler | 53/218 |
| 2,066,449 | 1/1937 | Barrett | 53/218 |
| 2,858,657 | 11/1958 | Guthrie | 53/218 |
| 3,222,909 | 12/1965 | Goettl | 72/306 |
| 3,327,452 | 6/1967 | Cranston | 53/218 |
| 3,404,507 | 10/1968 | Feigel | 53/218 X |
| 3,685,253 | 8/1972 | Herrell | 53/218 X |
| 3,896,607 | 7/1975 | Royal | 53/218 X |

*Primary Examiner*—John Sipos
*Attorney, Agent, or Firm*—George B. Oujevolk

[57] ABSTRACT

An arrangement for forming a box-shaped covering body using a single flat covering metal sheet by placing the covering sheet over the top surface of the article being covered; pressing the covering flat sheet immovably on the article or product being covered by means of holding members; bending the left and right side portions of the flat covering sheet downward by means of lateral-portion bending members, thereby forming lateral cover portions on the left and right side wall faces of the product being covered; folding the front and rear ends of the lateral cover portions toward the front and rear end faces of the product being covered by means of corner folding members, thereby forming front and rear corner folds at respective corners of the product being covered; bending down the front and rear end portions of the flat covering sheet by means of end-portion bending members, thereby forming front and rear end-face cover portions in conformity with the contours of the front and rear end wall faces of the product being covered, which have the front and rear corner folds of the covering sheet. The article or product being covered is utilized as a block for folding the flat covering sheet over it.

1 Claim, 15 Drawing Figures

APPARATUS FOR FORMING BOX-SHAPED COVERING BODY

BACKGROUND OF THE INVENTION

1. Field of the Invention

This invention relates to a novel method and apparatus for forming a box-shaped cover body for a product being covered, which consists of, for example, a plurality of steel sheets cut into a desired size and stacked in a superposed fashion, or the like.

2. Description of the Prior Art

In shipping a plurality of steel sheets cut into a desired size from an iron work factory, it has been customary that a cut sheet metal product, which consists of a plurality of steel sheets cut into a desired size and stacked in a superposed fashion is wrapped in a sheet of wrapping paper; a box-shaped cover body made of a metal sheet beforehand is fitted from above on the product packed in wrapping paper; applying a lower protective metal sheet to the under surface of the cut sheet metal product covered with a box-sheped cover body; and the cut sheet metal product covered with a box-shaped cover body and the lower protective metal plate are bound together by means of binding hoops.

In the conventional method, however, a number of box-shaped cover bodies must be prepared beforehand and kept in storage. This disadvantageously requires a large space for storage. Furthermore fitting a box-shaped cover body prepared beforehand on a cut sheet metal product wrapped in paper is cumbersome. A further disadvantage is in that, in order to facilitate the fitting of a box-shaped cover body on a cut sheet metal product, the inner size of the box-shaped cover body must be made larger to some extent than an outer size of the cut sheet metal product, resulting in the poor fit to the cut sheet metal product.

SUMMARY OF THE INVENTION

It is accordingly a primary object of the present invention to form a box-shaped cover body for a cut sheet metal product, wherein, in case of covering a cut sheet metal product or the like with a covering material, a single flat covering metal sheet is bent into a box shape in conformity with an outer contour of the cut sheet metal product, by utilizing the cut metal sheet product as a bending block, thereby providing a box-shaped cover body with ease.

It is a secondary object of the present invention to eliminate the need of preparing a number of box-shaped covers beforehand as well as keeping such covers in storage, and hence, a storage space for such covers.

It is a third object of the present invention to eliminate the procedure of fitting a box-shaped cover body beforehand prepared on a cut metal sheet product.

It is a fourth object of the present invention to provide an apparatus for forming a box-shaped cover body, wherein the apparatus comprises; covering-sheet holding members for holding a flat covering sheet immovably on the top surface of a cut sheet metal product being covered, the holding members consisting of a pair of intermediate top-surface holding members adapted to displace in a direction to get access to or go away from each other, and two pairs of front and rear end-surface holding members adapted to displace in a direction to get access to or go away from the front and rear ends of said intermediate top-surface holding members; whereby box-shaped covers different in top surface dimension are obtained by a single folding apparatus, depending on a top-surface dimension of a product being covered.

It is a fifth object of the present invention to provided an apparatus for forming a box-shaped cover body, wherein lateral-portion bending members, corner folding members and end-portion bending members all of which are attached to covering-sheet holding members, are pivotally moved by fluid-pressure type cylinder units, thereby folding a single flat covering sheet into a box-shaped cover body with each and rapidly.

BRIEF DESCRIPTION OF THE DRAWINGS

FIGS. 1 through 8 are illustrative of an apparatus for forming a box-shaped cover body, by which the method of the present invention is embodied, wherein;

FIG. 1 is a perspective view of the apparatus, with support members omitted;

FIG. 2 is a plan view of FIG. 1;

FIG. 3 is a side elevational view;

FIG. 4 is a front view;

FIG. 5 is a fragmentary, transverse cross sectional, plan view;

FIG. 6 is an enlarged plan view of the vicinity of a width adjusting device;

FIG. 7 is a longitudinal cross sectional, front view of FIG. 6; and

FIG. 8 is an enlarged longitudinal cross sectional elevational view of the vicinity of the width adjusting device; and, FIGS. 9 through 13 show the procedures of bending a covering metal sheet into a box-shaped cover body, wherein;

DESCRIPTION OF THE PREFERRED EMBODIMENTS

Figure 1:
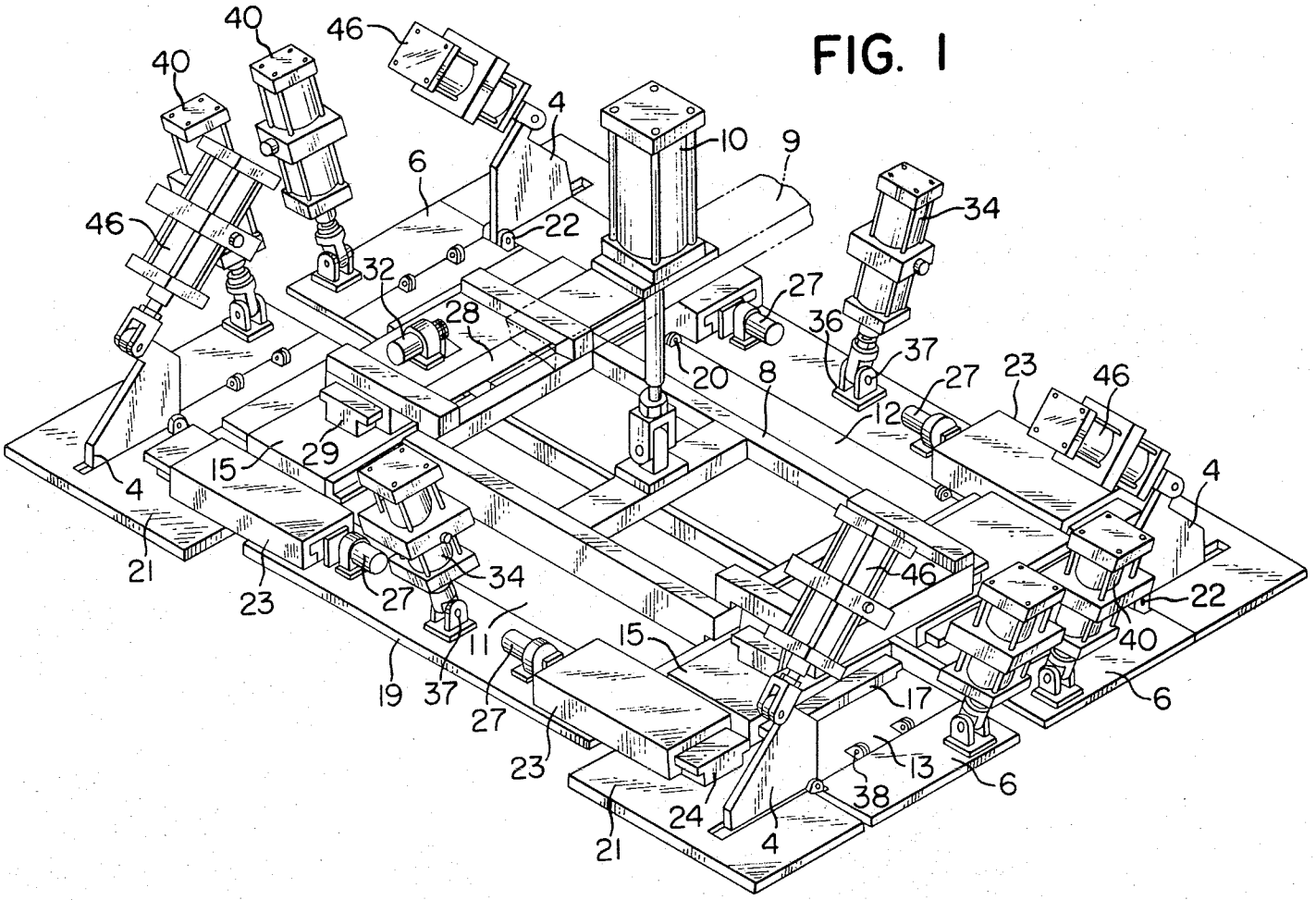
Figure 2:
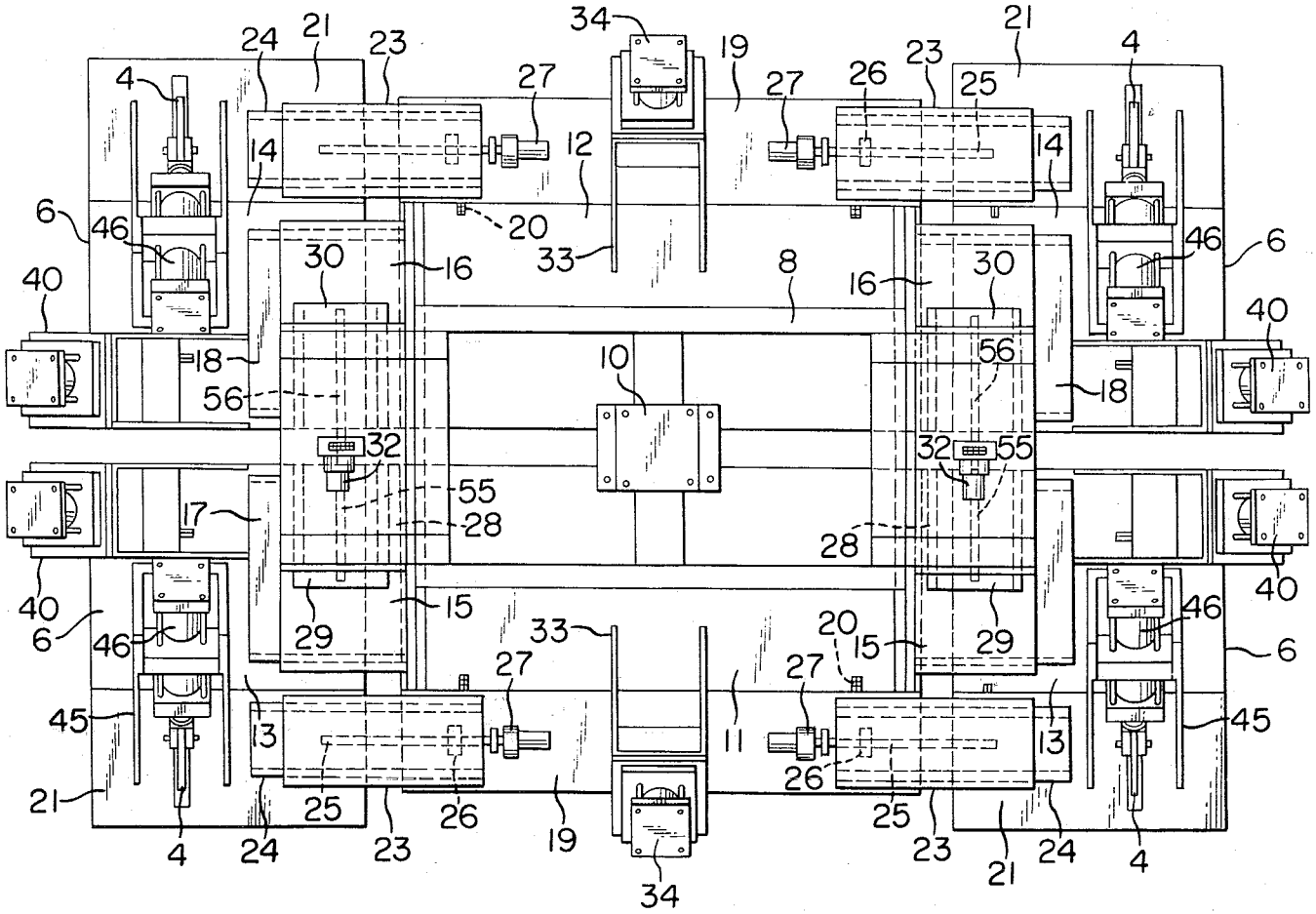
Figure 3:
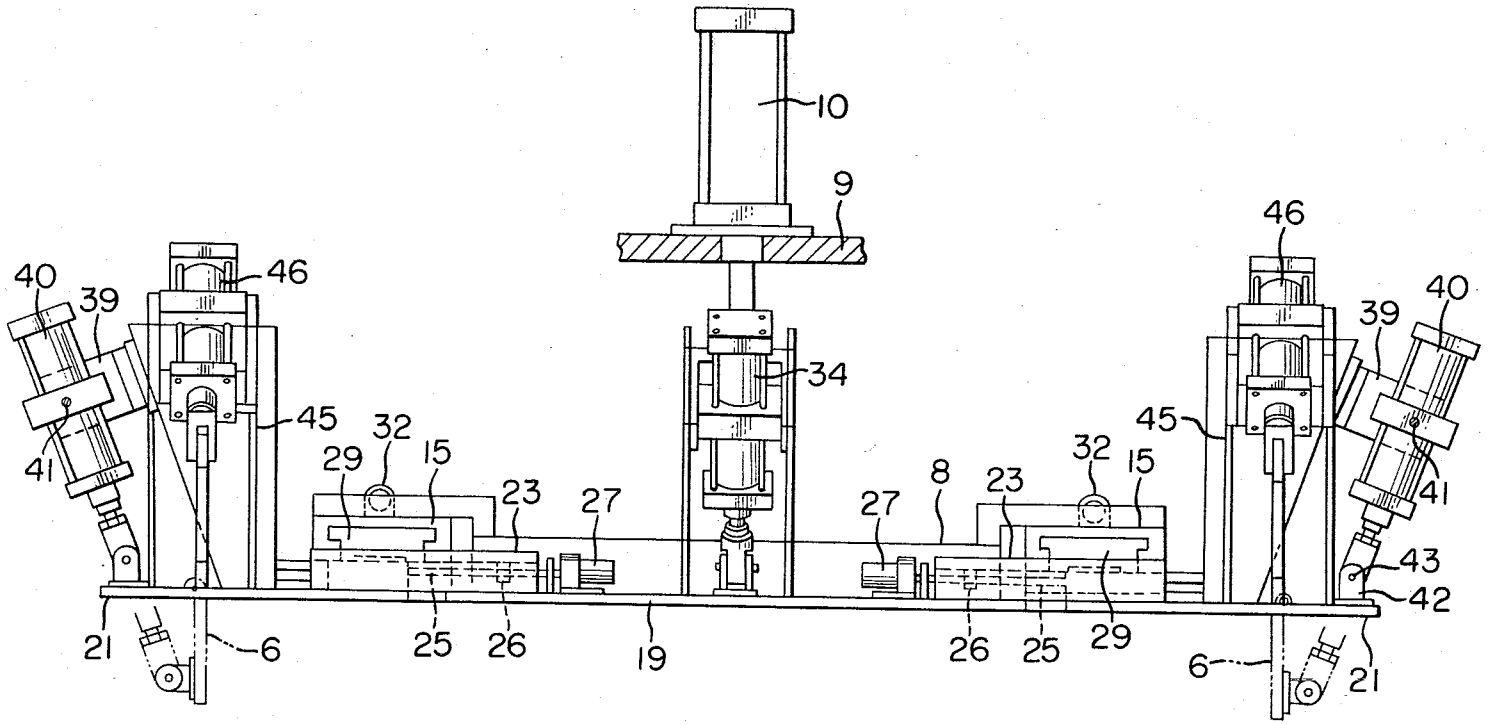
Figure 4:
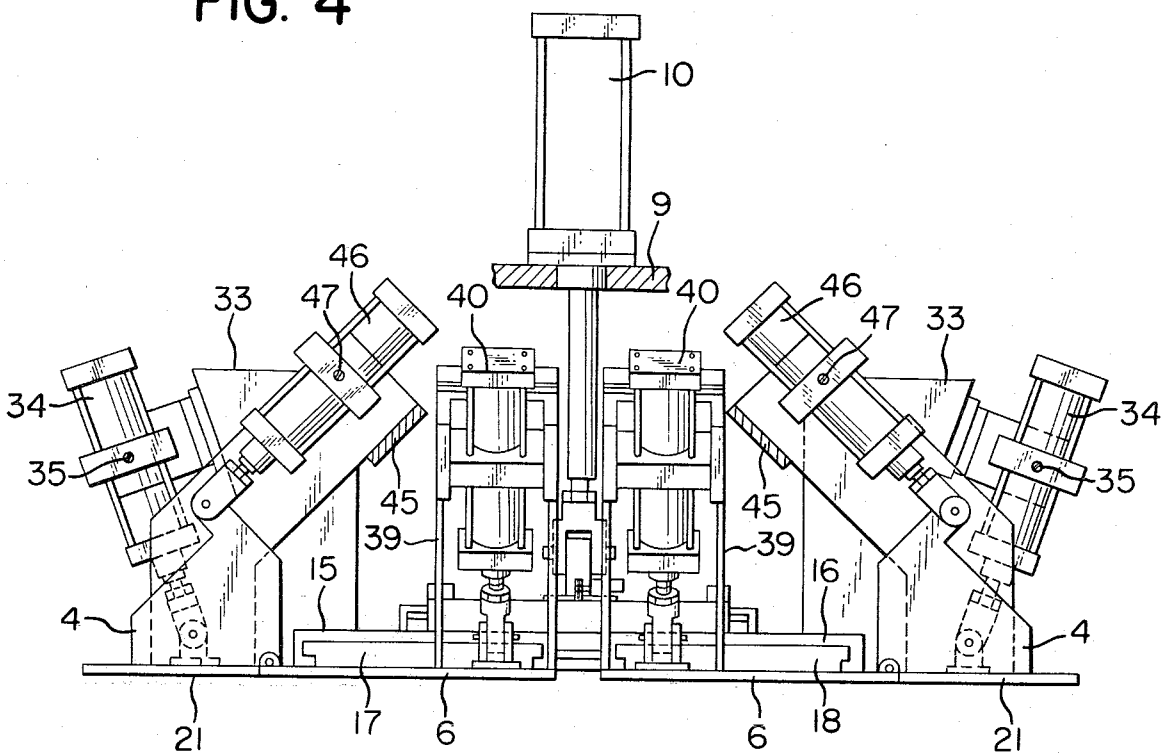
Figure 5:
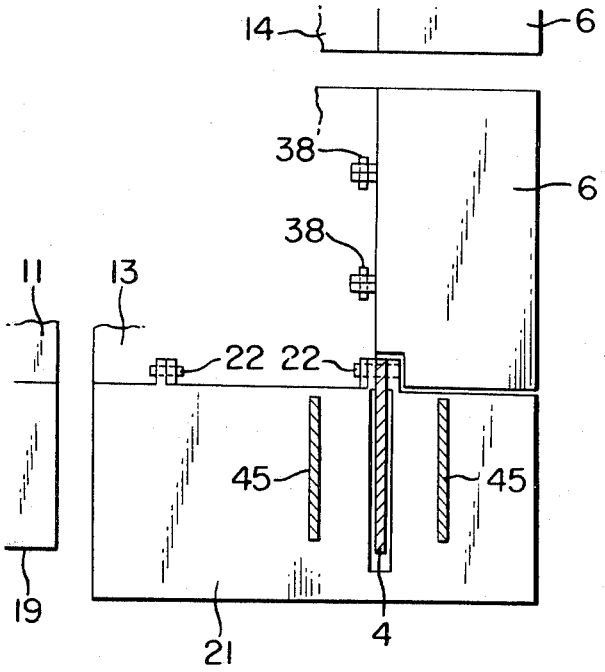
Figure 8:
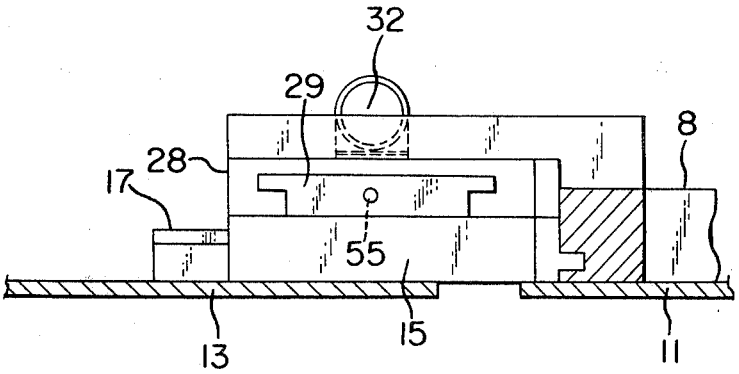
Figure 6:
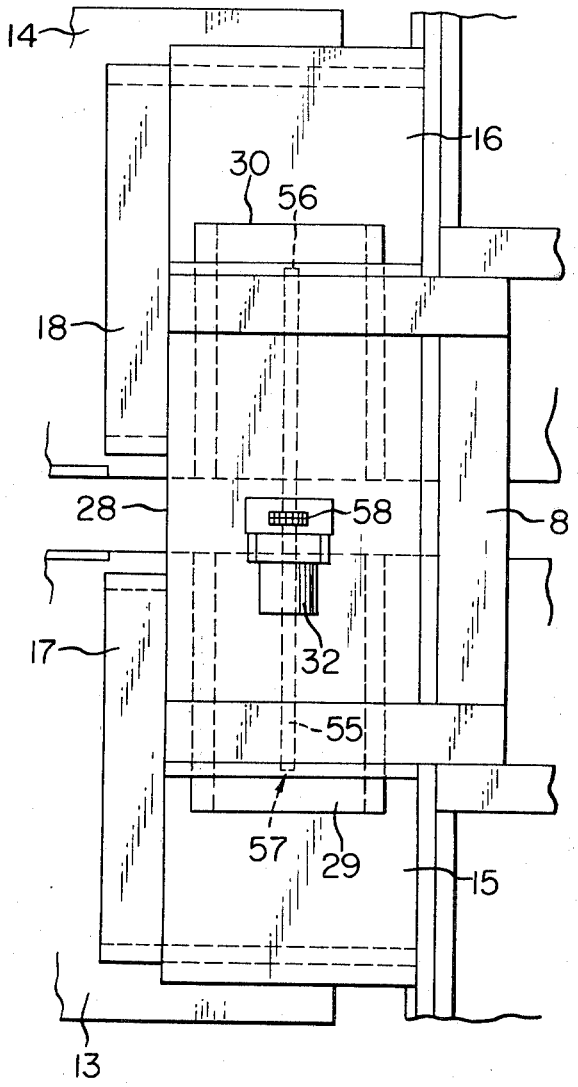
Figure 7:
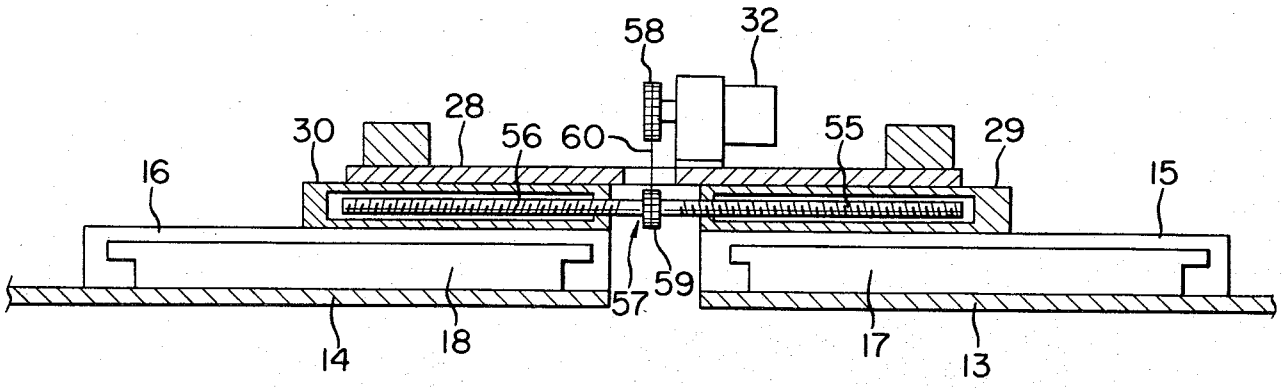
Figure 9:
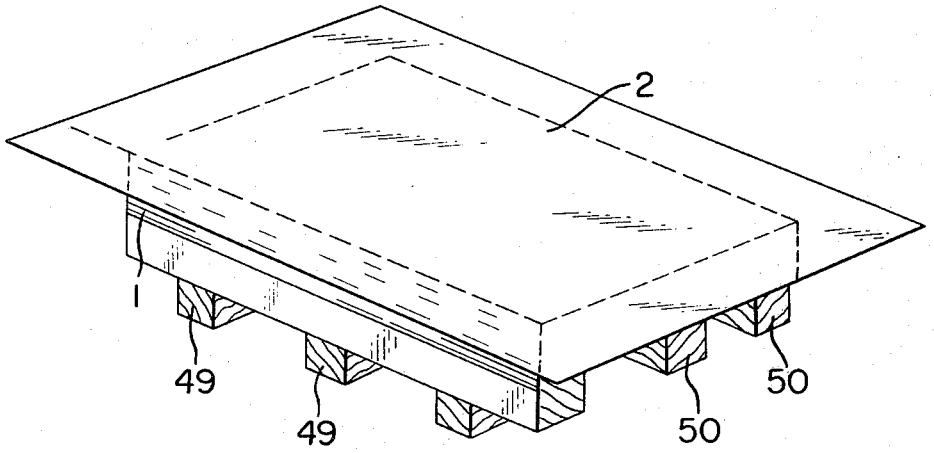
FIG. 9 is a perspective view of a sheet of covering metal placed on the top surface of a cut sheet metal product being covered.

FIGS. 1 through 8 are illustrative of an apparatus for forming a box-shaped cover, by which the method of the present invention is realized. A support frame 8 is connected in the central portion thereof to a frame 9 of a folding device by means of a lifting, fluid-pressure type, vertical cylinder unit 10. Top-surface-intermediate-portion-holding, horizontal members 11 and 12 for holding the intermediate portion of the top surface of a cut sheet metal product being covered (hereinafter referred to as intermediate-portion holding members) are provided in side-by-side relation to and on the same plane with the left and right members of the support frame 8, slidably in a transverse direction (vertically as viewed in FIG. 2) of the apparatus. Front and rear end-portion holding, horizontal members 13 and 14 for holding the end portions of the top surface of a cut sheet metal product being covered (hereinafter referred to as front and rear end-portion holding members) are provided at the front and rear of the intermediate-portion holding members 11 and 12 on the same plane therewith. Front and rear guide members 15 and 16 having flanges extending longitudinally of the apparatus, and a groove-shaped cross section, are attached to the front and rear portions of the intermediate-portion holding members 11 and 12. The front and rear guide members 15 and 16 receive therein longitudinally slidable members 17 and 18, which in turn are attached to the end-portion holding members 13 and 14.

Lateral-intermediate-portion bending members 19 for bending down the lateral intermediate portion of a cut sheet metal product being covered (hereinafter referred to as intermediate-portion bending members) are secured by longitudinal extending shafts 20 to the transversely opposite outer edges of the left and right, intermediate-portion holding members 11 and 12, respectively. Lateral-end-portion bending members 21 for bending down the lateral end portions of a cut sheet metal product being covered are secured by longitudinally extending shafts 22 to the transversely opposite outer edges of the front and rear end-portion holding members 13 and 14. Front and rear guide members 23 with longitudinally extending flanges and a groove-shaped cross section, are attached to the front end rear portions of the intermediate-portion bending members 19. Two pairs of front and rear longitudinal movable members 24 attached to the end-portion bending members 21 are slidably fitted in the front and rear guide members 23.

Longitudinally extending, length-adjusting, screw rods 25 are screwed with nuts 26 attached to the longitudinally movable members 24, respectively, and connected to output shafts of drive units 27 respectively consisting of an electric motor with reduction gears and attached to the intermediate-portion bending members 19, so that when the length-adjusting screw rods 25 are rotated in the normal direction or reverse direction by the drive units 27, respectively, then end-portion bending members 21 and end-portion holding members 13 and 14 coupled thereto are displaced longitudinally of the apparatus to thereby get access to or go away from the intermediate-portion bending members 19 and the intermediate-portion holding members 11 and 12.

Transversely extending, front and rear guide members 28 having longitudinally extending flanges and groove-shaped cross sections, respectively, are attached to the front and rear members of the support frame 8. Transversely movable members 29 and 30 attached to the top surfaces of the front and rear guide members 15 and 16 are slidably fitted into the left and right sides of the transversely extending, front and rear guide members 28, respectively. Width-adjusting, screw rods 57 respectively having a right hand screw 55 in one half of the rod and a left hand screw 56 in the other half thereof are rotatably carried through the medium of bearings by the transversely extending, front and rear guide members 28, with the right hand screws 55 and left hand screws 56 screwed with male screw portions of the transversely movable members 29 and 30. Chain drive wheels 58 are mounted on output shafts of drive units 32 respectively consisting of an electric motor with reduction gears and mounted on the transversely extending front and rear guide members 28, respectively. A gearing chain 60 is trained about respective chain drive wheel 58 and a chain drive wheel 59 mounted on respective width-adjusting screw rod 57 at the mid point thereof, so that when the width-adjusting, screw rods 57 are rotated in the normal direction or in the reverse direction by the driven units 32, then the front and rear guide members 15 and 16 and members supported by these guide members are moved toward or away from each other, thereby adjusting a transverse size of the apparatus.

Lateral-portion support members 33 are attached at the lower portions thereof to the mid points of the top surfaces of the intermediate-portion holding members 11 and 12, respectively. Cylinders of fluid-pressure type, lateral cylinder units 34 are secured by pins 35 to the upper portions of the lateral-portion support members 33. The fluid-pressure type, lateral cylinder units 34 have piston rods, respectively, one ends of which are pivotally secured by a pins 37 to fitting metals 36, which in turn are attached to the mid points of respective-portion bending members 19, so that when the fluid-pressure type, lateral cylinder units 34 are operated to an expanded position or contracted position, then the intermediate-portion bending members 19 and the lateral end-portion bending members 21 connected by way of the front and rear guide members to the members 19 are pivotally moved about the shafts 20 and 22 to assume horizontal or folded positions, respectively.

Front and rear end-portion bending members 6 are pivotally secured by transversely extending shafts 38 to the longitudinally opposite outer edges of the end-surface holding members 13 and 14. End-portion support members 39 are attached at the lower portions thereof to the end-surface holding members 13 and 14. Cylinders of fluid-pressure type, end-portion cylinder units 40 are attached by pins 41 to the upper portions of the end-portion support members 39. The fluid-pressure type, end-portion cylinder units 40 have piston rods, respectively, one ends of which are secured by pins 43 to connecting metals 42, which in turn are attached to the end-portion bending members 6, so that when the fluid-pressure type, end-portion cylinder units 40 are operated to an expanded or contracted position, the end-portion bending members 6 are pivotally moved about the shafts 38 to assume a horizontal or folded position.

Front and rear corner-portion folding members 4 respectively consisting of substantially a triangular plate member are pivotally movably secured by longitudinally extending shafts 22 to the transversely outer edges of the end-surface holding members 13 and 14. Corner support members 45 are attached at the lower ends thereof to the lateral-end-portion bending member 21. Cylinders of fluid-pressure type corner-portion cylinder units 46 are attached by pins 47 to the upper portions of the corner support member 45. The fluid-pressure type, corner cylinder units 46 have piston rods, respectively, one ends of which are pivotally attached by pins 48 to the corner folding members 4, so that when the fluid-pressure type corner cylinder units 46 are expanded or contracted, the corner folding members 4 are pivotally moved vertically about the shafts 22 to assume a folded position or an upright position.

Description will be given to the process for forming a box-shaped, rust-proof cover body for a cut sheet metal product being covered which consists of cut steel sheets stacked in a superposed fashion, by using the folding apparatus described in conjunction with FIGS. 1 through 8.

At first, plural longitudinal bars 50 are placed on plural cross bars 49, and a product being covered 1 which consists of a plurality of cut steel sheets stacked in a superposed fashion is placed on the bars. A flat covering sheet 2, such as a sheet steel or a sheet of comparatively thick, water-proof protective paper, having a dimension large enough to cover the top surface and the outer peripheral surface, of the product being covered 1, is placed properly on the top surface of the product being covered. A length between the transversely opposite, outer edges of the left and right, intermediate-surface holding members 11 and 12 and a length between the transversely opposite, outer edges of the left and right, end-surface holding members 13 and 14 are adjusted to a size substantially equal to a transverse size of the product being covered 1, and lengths between the longitudinally opposite, outer edges of respective front and rear end-surface holding members 13 and 14 (namely, a longitudinal length of the apparatus) are adjusted to a size substantially equal to a longitudinal size of the product being covered 1. Thereafter, the position of the product being covered 1 is adjusted, with the center of the former coincident with the center of a group of holding members consisting of the intermediate-surface holding members 11,12 and end-surface holding members 13,14.

Figure 10:
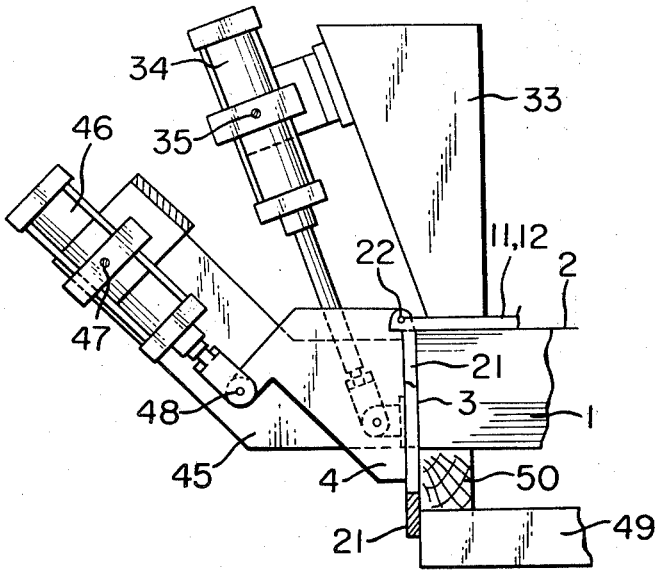
FIG. 10 is a fragmentary, longitudinal cross sectional front view for showing how a lateral portion of the sheet of covering metal is bent.
Figure 11:
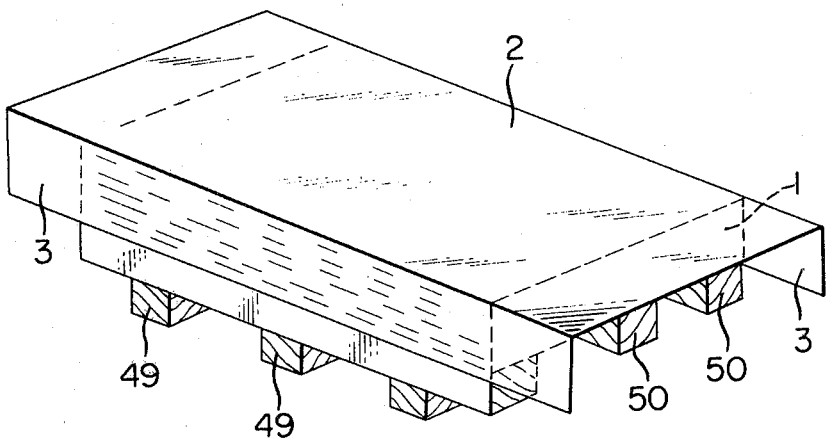
FIG. 11 is a perspective view of the sheet of covering metal, with the left and right lateral portions bent downward.

The lifting, fluid-pressure type cylinder unit 10 is expanded in the manner shown in FIG. 10, thereby moving down the support frame 8 and its associated members directly and indirectly supported by the frame. As the intermediate-surface holding members 11,12 and the end-surface holding members 13,14 are pressed on the flat covering sheet placed on the top surface of the product being covered 1, the fluid-pressure type lateral cylinder units 34 are expanded, thereby pivotally moving the lateral-intermediate bending members 19 and the lateral-end bending members 21 from a horizontal position to substantially a vertical position, whereby the left and right longitudinal side portions of the flat covering sheet 2 are bent down substantially at a right angle with respect to the top surface of the product being covered, thereby forming left and right lateral cover portions 3 covering entirely the left and right lateral portions of the product being covered 1 (FIG. 11).

Figure 12:
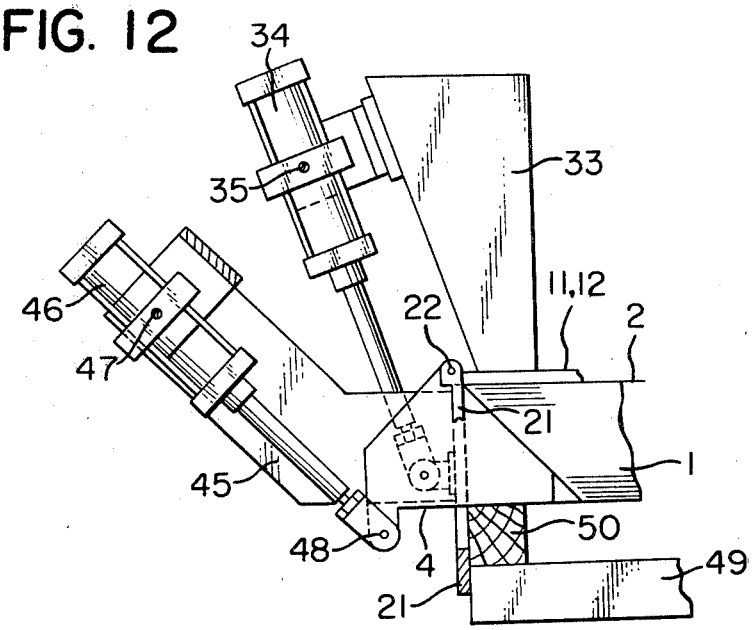
FIG. 12 is a fragmentary longitudinal cross sectional front view showing how a corner portion of the covering sheet is bent.
Figure 13:
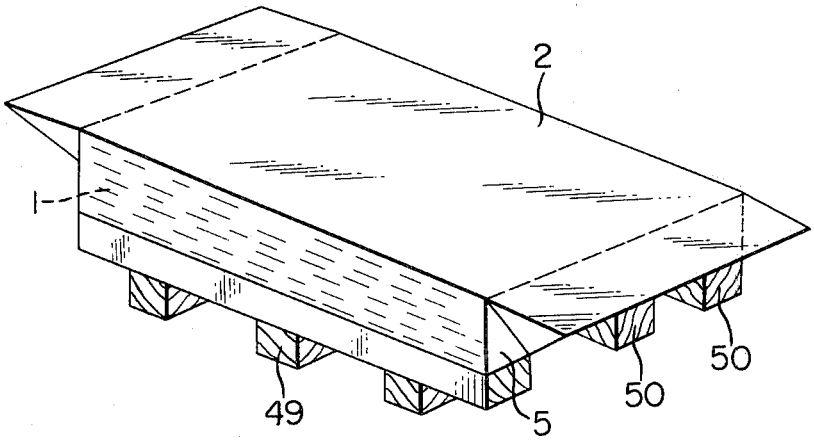
FIG. 13 is a perspective view of the covering sheet, with one corner folded along an end face of the cut sheet metal product; and, FIG. 14 is a perspective view of a complete box-shaped cover body; and, FIG. 15 is a plan view of a modified apparatus for forming a box-shaped cover body.

The fluid-pressure type corner cylinder units 46 are expanded in the manner shown in FIG. 12, thereby pivotally moving the triangular corner folding member 4 from positions adjacent to the outer surfaces of the left and right lateral cover portions 3 through about 90° to positions in parallel to the front and rear end and faces of the product being covered 1, thereby forming triangular corner folds 5 in an opposing relation to each other on the front and rear end faces of the product being covered, as shown in FIG. 13. The fluid-pressure type, corner cylinder units 46 are then contracted, thereby pivotally moving the triangular corner folding members 4 sideways from the front and rear end faces of the product being covered, and on the other hand, the fluid-pressure type, and cylinder units 40 are expanded, thereby pivotally moving end-portion bending members 6 from a substantially horizontal position down-to substantially a vertical position, whereby the front and rear ends of the covering sheet 2 are bent at substantially a right angle with respect to the top surface of the product, thereby forming front and rear end face cover portions 7 covering entirely the front and rear end faces of the product being covered, which have the triangular corner folds 5.

Figure 14:
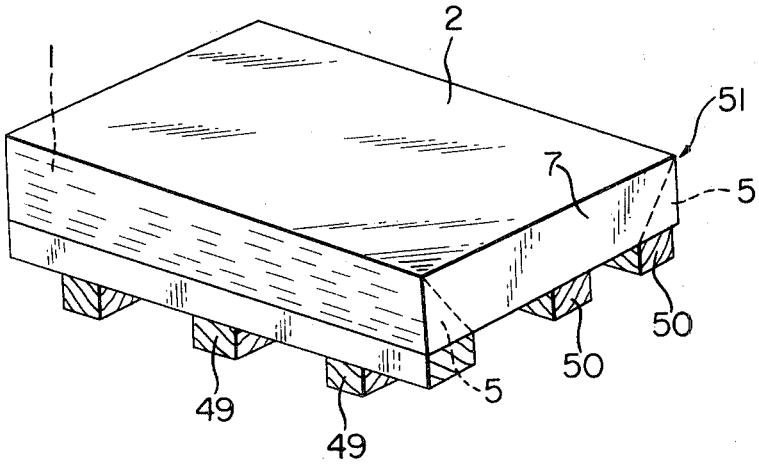

The fluid-pressure type lateral cylinder units 34 and the fluid-pressure type end cylinder units 40 are operated to contracted positions, whereby the lateral-intermediate bending members 19, lateral-end bending members 21, and end portion bending members 6 are pivotally moved to the upper horizontal positions as shown in FIG. 1, and then, the fluid-pressure type lifting cylinder unit 10 is contracted, thereby moving up the support frame 8 and respective members directly and indirectly supported by the frame. FIG. 14 shows the cut sheet metal product 1 covered with a complete box-shaped cover body 51 formed according to the procedures described above. The cut sheet metal product covered with the box-shaped cover body 51 and the cross bars 49 and longitudinal bars 50 are bound together by cross hoops and longitudinal hoops.

It is recommended to wrap the product being covered 1 with a sheet of water-proof paper, prior to formation of the box-shaped cover body.

Figure 15:
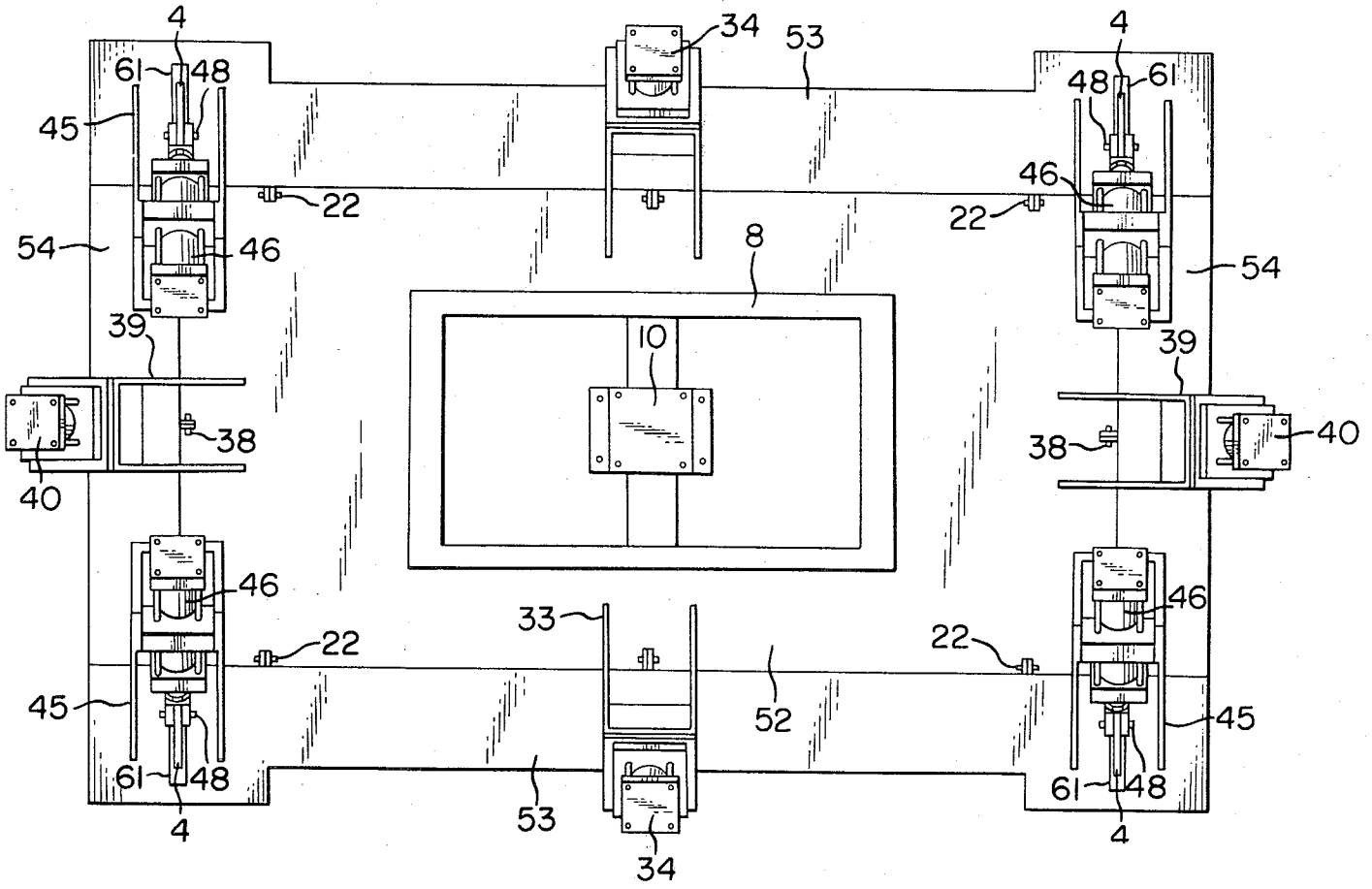

FIG. 15 shows another embodiment of the apparatus for forming a box-shaped cover body. In this embodiment, there is provided a top-surface holding member 52 having a dimension substantially equal to a dimension of a top surface of a product being covered. Left and right, lateral-portion bending members 53 are secured by longitudinal extending shafts 22 to the transversely opposite, outer edges of the top-surface holding member 52. Front and rear end-portion bending members 54 are pivotally movably secured by transversely extending shafts 38 to the front and rear outer edges of the top-surface holding member 52. Lateral-portion support members 33 are attached at the lower portions thereof to the left and right hand top surface of the top-surface holding member 52. Cylinders of fluid-pressure type, lateral cylinder units 34 are attached by pins to the upper portions of the lateral support members 33, respectively. The fluid-pressure type, lateral cylinder units 34 have piston rods, respectively, one ends of which are attached by pins to the lateral-portion bending members 53. Front and rear end support members 39 are attached at the lower ends thereof to the front and rear portions of the top surface of the top-surface holding member 52. Cylinders of front- and rear-end, fluid-pressure type, cylinder units 40 are attached by pins to the upper portions of the front and rear-end support members 39. The front- and rear-end fluid-pressure cylinder units 40 have piston rods, respectively, one ends of which are secured by pins to the front- and rear-end-portion bending member 54.

Corner-portion support members 45 are attached at the lower portions thereof to the front and rear portions of the top surface of the lateral-portion bending members 53. Cylinders of fluid-pressure type, corner cylinder units 46 are attached by pins to the upper portions of the corner-portion support members 45. Corner folding member 4 are pivotally movably secured by longitudinally extending shafts to the front and rear portions of the left and right, outer edges of the top-surface holding member 52. The lateral-portion bending members 53 have slits 61, into each of which each corner folding member is inserted. The fluid-pressure type, corner cylinder units 46 have piston rods, respectively, one ends of which are secured by pins 48 to the corner folding members 4, respectively. The support frame 8 is attached to the central top surface of the top-surface holding member 52, and the support frame 8 and the frame of the folding apparatus are connected each other by means of a lifting, fluid-pressure type, cylinder unit 10.

The lifting, fluid-pressure cylinder unit 10, lateral-portion fluid-pressure cylinder units 34, end-portion fluid-pressure cylinder units 40 and corner-portion fluid-pressure cylinder units 46 may be of an air cylinder unit or a hydraulic cylinder unit.

What is claimed is:

1. A folding apparatus for forming a box-shaped cover body by bending a flat metal sheet to a snug fit over a rectangular shaped article beind covered, said apparatus having a longitudinal axis comprising in combination:

I. left and right support frames on opposing sides of said longitudinal axis with each of said support frames comprising:

(a) slidably adjustable intermediate-portion-holding member (11, 12), with a top and bottom surface, said bottom surface acting to hold the intermediate portion of the top portion of an article being covered, said intermediate-portion-holding member (11, 12) having longitudinally front and rear portions;

(b) slidably adjustable longitudinally front and rear end-portion holding members (13, 14) with longitudinally slidable members (17, 18) attached thereto, said front and rear end-portion holding members serving to hold the end portions of said article and being disposed at the front and rear of said intermediate-portion-holding member (11, 12) in the same plane therewith;

(c) first front and rear guide members (15, 16) having longitudinally extending flanges and a groove-shaped cross-section attached to the front and rear portions of the intermediate-portion-holding member (11, 12), said front and rear guide members (15, 16) receiving said longitudinally slidable members (17, 18);

(d) lateral intermediate-portion bending member (19) for bending down the corresponding portions of the sheet of metal used to cover the article and pivotally mounted to said intermediate-portion-holding member (11,12), front and rear lateral end portion bending members (21) for bending down the lateral end portions of said sheet of metal and pivotally mounted to the front and rear end-portion holding members (13,14);

(e) second front and rear guide members (23) with longitudinally extending flanges and groove-shaped cross sections attached to the front and rear end portions of the intermediate-portion bending member (19), front and rear longitudinal movable members (24) attached to the end-portion bending members (21) and slidably fitted in the front and rear guide members (23), first drive means (27) with output shafts, longitudinally extending length-adjusting screw rod means (25, 26) attached to the longitudinally movable members (24) and connected to said output shafts of the first drive means (27);

(f) lateral-portion support member (33) with a lower and an upper portion, attached at said lower portion to the midpoint of said top surfaces of the intermediate-portion holding member (11, 12), pivotally supported fluid pressure lateral cylinder unit (34) including piston rod secured to said upper portions of said lateral-portion support member (33), said piston rod being pivotally secured to the midpoint of said intermediate portion bending member (21) moving said lateral intermediate and end portion bending members to assume folded positions;

(g) front and rear corner-portion folding members (4) including a substantially triangular plate member pivotally movably secured to the end-portion holding members (13, 14), fluid-pressure cylinder units mounted on the lateral end-portion bending members (21) with piston rods (46) attached to the corner folding members (4) so that when they are expanded or contracted, the corner folding members are pivotally moved to assume a folded or an upright position; and, (h) front and rear end-portion bending members (6) with a lower part, pivotally secured to opposite end-surface holding members (12, 14), fluid pressure end-portion cylinder units (40) including piston rods attached to the end-portion bending members (6) so that when the fluid pressure end-portion cylinder units (40) are operated to expand or contracted positions, the end-portion bending members (6) are pivotally moved to assume a folded position;

II. front and rear width adjusting means with each said front and rear adjusting means comprising: transversely extending third guide members (28) with transversally extending flanges and groove-shaped cross-sections, left and right transversely movable members (29, 30) attached to the first left and right guide members (15, 16) and slidably disposed into the left and right sides of said transversely extending third guide members (28), transversely extending width adjusting screw rods (57) with second drive means (58, 60) connected to said transversely movable members (29, 30) to adjust the width thereof;

whereby, an article is covered by placing a flat metal cover sheet on the top surface thereof, the intermediate portion of the cover sheet being pressed on the article by the intermediate-portion-holding members (11, 12), the left and right lateral-portion bending members (19, 21) being pivotally moved so that the left and right side portions of the flat metal cover sheet are bent down to form left and right lateral cover portions along the left and right wall faces of the article, the, pivotally moving corner folding members (4) from the outer sides of said left and right lateral cover portions of said cover sheet toward the front and rear end faces of said article there by folding corners of said left and right lateral cover portions traversely inward of the article, parallel to the front and rear end faces thereof, forming triangular corner folds at the corners, pivotally moving end-portion bending members (6) downward, thereby folding down the front and rear end portions of said cover sheet to form front and rear end-face cover portions in conformity with the contours of the front and rear end faces of said article as well as said front and rear triangular corner folds.

* * * * *